US009670719B2

(12) United States Patent
Marocco

(10) Patent No.: US 9,670,719 B2
(45) Date of Patent: Jun. 6, 2017

(54) DOUBLE BLIND WITH VERTICAL SHADE

(71) Applicant: Mario M Marocco, Toronto (CA)

(72) Inventor: Mario M Marocco, Toronto (CA)

( * ) Notice: Subject to any disclaimer, the term of this patent is extended or adjusted under 35 U.S.C. 154(b) by 0 days.

(21) Appl. No.: 14/545,519

(22) Filed: May 15, 2015

(65) Prior Publication Data

US 2017/0009519 A1 Jan. 12, 2017

Related U.S. Application Data

(63) Continuation-in-part of application No. 13/506,714, filed on May 11, 2012, now Pat. No. 9,062,493.

(51) Int. Cl.

| | |
|---|---|
| ***E06B 9/264*** | (2006.01) |
| ***E06B 9/24*** | (2006.01) |
| ***E06B 9/40*** | (2006.01) |
| ***E06B 9/42*** | (2006.01) |
| ***E06B 9/78*** | (2006.01) |
| ***E06B 9/44*** | (2006.01) |
| ***E06B 9/50*** | (2006.01) |
| *E06B 9/58* | (2006.01) |

(52) U.S. Cl.

CPC ..... *E06B 9/24* (2013.01); *E06B 9/264* (2013.01); *E06B 9/40* (2013.01); *E06B 9/42* (2013.01); *E06B 9/44* (2013.01); *E06B 9/50* (2013.01); *E06B 9/78* (2013.01); *E06B 2009/2405* (2013.01); *E06B 2009/2423* (2013.01); *E06B 2009/2452* (2013.01); *E06B 2009/405* (2013.01); *E06B 2009/583* (2013.01); *E06B 2009/785* (2013.01)

(58) Field of Classification Search

CPC ..... E06B 9/264; E06B 2009/2423; E06B 2009/2429; E06B 2009/2435; E06B 2009/2447; E06B 2009/2452; E06B 2009/2458

USPC ..... 160/89, 108, 168.1 V, 173 V, 22

See application file for complete search history.

(56) References Cited

U.S. PATENT DOCUMENTS

| | | | | | |
|---|---|---|---|---|---|
| 1,601,665 | A * | 9/1926 | Alphin | A47H 1/13 | 160/112 |
| 1,636,601 | A * | 7/1927 | Alex | E06B 9/44 | 160/108 |
| 2,175,761 | A * | 10/1939 | Quinlan | A47H 2/00 | 160/108 |
| 2,391,150 | A * | 12/1945 | Ganter | A47H 2/00 | 160/124 |
| 2,604,159 | A * | 7/1952 | Wright | E06B 9/367 | 16/87.6 R |
| 3,990,635 | A * | 11/1976 | Restle | E06B 9/24 | 126/591 |
| 4,114,233 | A * | 9/1978 | Hamilton | A47H 1/04 | 16/95 R |
| 4,369,829 | A * | 1/1983 | Casiday | E06B 9/40 | 160/120 |
| 4,453,584 | A * | 6/1984 | Steele | E06B 9/24 | 160/121.1 |

(Continued)

*Primary Examiner* — David Purol

(57) ABSTRACT

A blind for a building opening, and having an upper blind roller, located in an upper region of the head rail, a lower blind attachment located in a lower region of the head rail, an upper blind stored on the upper blind roller, a lower blind stored on the lower blind attachment, a lower blind support wall, and a blind carriage mechanism thereon, for carrying vertical blind slats, so as to provide a head rail having a slim, aesthetically pleasing profile.

3 Claims, 18 Drawing Sheets

(56) References Cited

U.S. PATENT DOCUMENTS

| | | | | |
|---|---|---|---|---|
| 4,724,885 | A * | 2/1988 | Chang | E06B 9/32 160/176.1 R |
| 5,205,334 | A * | 4/1993 | Judkins | B23Q 3/15526 160/108 |
| 5,392,833 | A * | 2/1995 | Ohanesian | A47H 1/00 160/168.1 R |
| 5,505,418 | A * | 4/1996 | Corcoran | E06B 9/50 160/178.1 R |
| 5,520,235 | A * | 5/1996 | Coleman | A47H 1/06 160/126 |
| 6,712,115 | B2 * | 3/2004 | Judkins | E06B 9/264 160/178.1 R |
| 6,941,996 | B2 * | 9/2005 | Ward | E06B 9/32 160/108 |
| 7,059,377 | B2 | 6/2006 | Nien | |
| 7,806,160 | B2 * | 10/2010 | Byeon | E06B 9/40 160/11 |
| 8,261,808 | B2 * | 9/2012 | Perkowitz | A47H 2/00 160/108 |
| 2004/0221967 | A1 * | 11/2004 | Ikle | E06B 9/11 160/120 |

* cited by examiner

DOUBLE BLIND WITH VERTICAL SHADE

This application is a Continuation in Part of application Ser. No. 13/506,714 filed May 11, 2012, Title: Blind Assembly with two blind head rail; Inventor, Mario M. Marocco, which was a CIP of application Ser. No. 13/506,538 filed Apr. 26, 2012 Title: Blind Assembly with two blind head rails, Inventor Mario, M. Marocco which was a C.I.P of application Ser. No. 13/374,952, Filed Jan. 25, 2012, Title: Blind Head Rail with Control Guides, Inventor: Mario M Marocco; which was a C.I.P. of application Ser. No. 13/067,189, Filed May 16, 2011; Title: Double Blind and Head Rail, Inventor Mario M Marocco.

FIELD OF THE INVENTION

The invention relates to blinds for windows, in which there are at least two panels of blind material, which may hang double, The panels can be adjusted for various light and shade effects, and one panel can provide substantially complete black out if required, or can be rolled up into a head rail.

BACKGROUND OF THE INVENTION

In the past, conventional blinds for windows have typically been either venetian style blinds with transverse strips, or so called vertical blinds carried on individual trolleys on a horizontal track. These blinds could have a mechanism whereby the strips could be rotated between closed and open positions. However in the open position, in which light is transmitted into the room, there was also a loss of privacy. In the closed position, the light was obscured.

Other blinds are known which simply consist of a panel of thick flexible material, wound onto a roller. The material can be pulled down for privacy, and to obscure the light, or raised, to allow passage of light, but with loss of privacy.

Such basic roller blinds were relatively crude construction consisting simply of a roller with an interior spring, and a ratchet lock. There were also not particularly pleasing to the eye.

Recent developments in blind design have found that consumers are interested in obtaining blinds with a greater variety of light and shade effects, but which none the less provide for privacy preferably such blinds appealing to modern consumer tastes will have a more pleasing appearance, and be capable of fitting in with a variety of different interior design themes.

For this purpose, a window covering material may be provided, which is preferably somewhat translucent and is carried in the head rail. This covering material is light permeable, but provides privacy.

A second blind panel is stored in the head rail and is formed of opaque material. When complete light exclusion is required this second panel can be lowered.

In the first place the head rail must be compact and aesthetically pleasing. Desirably the blind head rail shall occupy no more space, or only slightly more space at the top of the window opening than previously known blinds.

The operation of the separate blind panels must be simple and capable of being operated by either manual controls, or in the case of more complex designs by means of power controls, and even remotely operated power controls.

One problem is experienced with such controls, is that some space must be allowed for the cord loops to hang beside one edge of the blind panels.

This space along one vertical edge of the blind panels, then allows some light in, and the blind fails to obscure all light.

Another problem is that when an operator manipulates the cords, the edges of the panels gradually become damaged. The appearance, and life, of the blind is therefor impaired.

BRIEF SUMMARY OF THE INVENTION

With a view to achieving the foregoing desirable features, the invention provides a blind for a building opening, and having a head rail attachable adjacent the building opening, said head rail defining upper and lower regions, and having; an upper blind roller, located in said upper region of said head rail, an upper blind stored on said upper blind roller, a lower blind attachment located in said lower region of said head rail, a lower blind carried on said lower blind attachment, upper blind control mechanism operable to lower and raise said upper blind, lower blind control mechanism operable to operate said lower blind;

The lower blind attachment is an elongated transverse horizontal wall member, and a transverse blind track is supported on said wall member, and wherein said upper blind is operable to depend down beside a predetermined side of said transverse horizontal wall member and wherein said lower blind is operable to depend down alongside but spaced from said upper blind, whereby to provide a head rail having a slim, aesthetically pleasing profile.

Control elements will be provided for operating both the lower and the upper blind, and control guides in the head rail guide the elements to hang free of the lower and upper blinds.

In one embodiment the upper blind is an opaque black out blind, and the lower blind comprises vertical strips and whereby when said upper blind is raised and said lower blind is deployed, some light will pass in, and wherein when said upper blind is lowered light is substantially excluded. The lower blind vertical strips can be drawn to one side, or can be rotated for varying light effects in this embodiment. To sufficiently lower window covering the horizontal wall member has a generally diagonal support leg extending upwardly from a median point of said horizontal wall member, and being attached to the interior of the front wall of the head rail. A guide rib can be provided on the rearward edge of the horizontal wall, for guiding the upper blind clear of the lower blind strips.

In another embodiment, the front or lower window covering may be a panel of material, pleated by a series of fold lines, and suspended from said horizontal wall.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
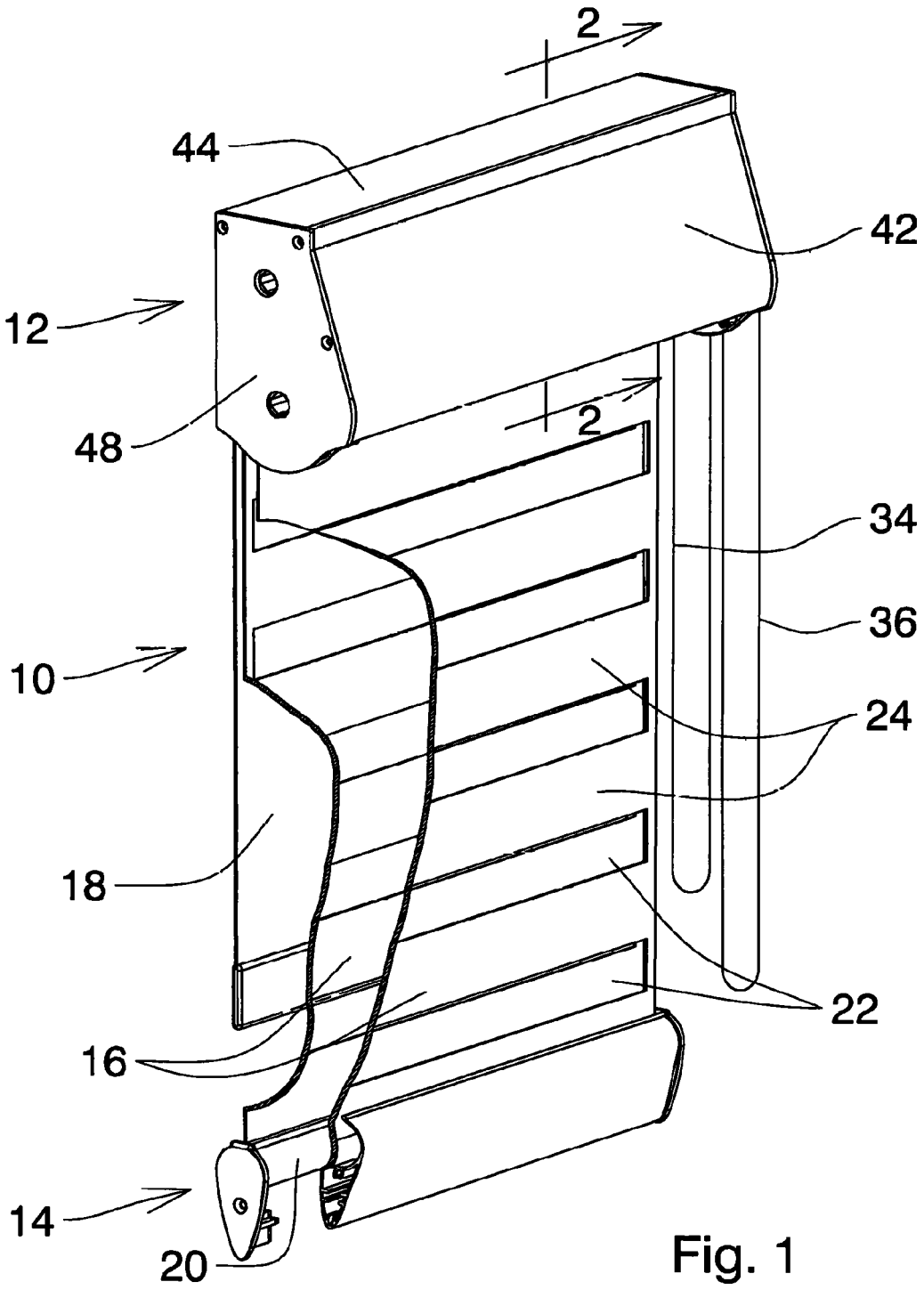
FIG. 1 is a general perspective of a typical blind illustrating the invention and showing a first looped blind panel, with alternating light and dark transverse blind strips, and a second opaque blind panel, and a head rail.

It will be seen that the blind here is illustrated generally as (10), comprises a head rail (12) and a bottom rail (14). The blind is typically located over a building opening such as a window.

The blind, in this first embodiment, provides a first or lower looped translucent blind panel (16) and a second or upper opaque blind panel (18). It will be seen that the first and second blind panels are supported so as to hang vertically. The second panel (18) has the usual bottom rail.

The first or lower blind is located in a lower region of the head rail, and is the lower blind.

The second blind panel is located in an upper region of the head rail, and is the upper blind.

First blind panel (16) is a continuous strip which passes around a bottom rail roller (20) in the bottom rail (14), and the free end is secured back up in the head rail (to be described below), so as to hold the looped panel in position.

As shown the front blind panel in this embodiment is a loop, so that its two portions form in effect two panel portions hanging down, one panel portion being spaced in front and the other behind.

The two panel portions can be considered as a front panel portion and an intermediate panel portion.

The second blind panel, which is the upper panel, hangs rearwardly behind the front and intermediate panel portions.

The first and second blind panels are spaced apart from one another.

The first blind panel, in this embodiment, is formed of light permeable material, which is at least partly translucent, so that light can pass through and permit at least some light to pass into the interior of the building, even when the first panel is lowered.

In order to provide for a variable lighting effect, namely a greater or lesser exclusion of light, first blind panel (16) is provided with transverse darker blind strips (22). Strips (22) are formed of thicker or darker material such that it is at least less light permeable, than the fabric of the blind panel. The strips (22) are located at spaced intervals.

Between the strips (22), spaces or strips (24) of the fabric of the first panel (16) are more light permeable, thus providing alternating light and dark strips.

As shown, the first panel hangs down in a loop. At its lower end it passes freely into and out of bottom rail (14), described below. Within rail (14), the free running roller or rod (20, guides and controls the first blind material. By adjusting the loop it is possible to either align the dark strips (22 in the two parts of the loop with each other, and thus align the light strips (24) with each other. This will provide passage of light through the lighter strips. By adjusting the loop slightly, the dark strips (22) in one part of the loop can be made to align or register with the light strips (24) in the other part of the loop, providing more privacy and less light.

By suitable mechanism (described below) the first and second blind panels can be adjusted, and raised or lowered, and can also be retracted back up into the head rail (12) in order to provide a completely open area in the building opening or window. In order to provide for these functions the head rail (12) carries an upper second panel roller (30) located in an upper region of the head rail, and a lower blind attachment, in this case a lower roller (32) which is located in a lower region of the head rail.

The two rollers define axes which are parallel, but spaced vertically apart from one another. Roller (32) is located below the roller (30).

It will be noted that the lower blind hangs from the rearward side of its roller. Similarly the upper blind hangs rearwardly from its roller. Both blinds therefor hang an the same side of their respective rollers, which makes for a more compact aesthetically please profile for the head rail.

The two rollers are operable, in this embodiment by control elements which in this case comprise respective first and second control cords, chains or the like, (34 and (36).

Head rail (12) comprises an elongated transverse channel, preferably formed of suitable material such as thermoplastic material, or a metal extrusion, and having screw receiving mouldings (40) formed therein.

Head rail (12) defines a front cover wall (42), a top wall (44) and a back wall (46). Suitable mounting devices (not shown), for securing the blind to a building, can be secured to the back wall or top wall, depending on the fabric of the building to which it is to be attached.

At each end of head rail (12) there is an end cap (48), preferably formed of thermoplastic.

The end cap (48) defines a flat planar exterior.

Screws can be passed through the end cap and secured in screw mouldings (40) in head rail (12).

Main body (50) is formed with integral upper and lower hub bearings (54) and (56), for carrying ends of respective rollers (30) and (32).

Drives for the rollers are operated by respective control elements, in this case upper and lower control cords or chains (34) and (36). Such cords, as is well known, hang down in endless loops, and one or other of the loop portions can be grasped and drawn down, to operate the respective blinds.

The cords, in this case, are the typical metal chain cord, having metal spheres connected together by wire links, such as are well known in the art. The spheres are also commonly made of thermoplastic, in a variety of colours.

Cords of other designs are known and could be used. All such cords, whether chains, or cords of any other type are referred to herein as control elements or cords, wherever these words are used, and are deemed to include all such chains, cords, and the like of whatever type.

The cord for the upper roller hangs well forward of the edges of the first and second blind panels (16) and (18).

The cord for the lower roller hangs forward of the edges of the first and second blind panels.

Each blind roller has a groove (80) in which edges of the respective blind panels are secured.

An intermediate loop fastening wall (82) which in this case is formed of extruded metal, for example, but could be formed in other ways, is secured in a groove (80) inside the front wall (42) of the head rail (12).

The wall (82) is, in this case, removable, by sliding out of the groove. However, the wall could be permanently fastened to the head rail, or could be formed integrally with the head rail.

The fastening wall (82) extends between the upper and lower rollers (30) and (32), and terminates adjacent to but spaced from the back wall (46). A first blind panel loop fastening groove (84) is formed along the free edge of wall (82). The free end of front looped blind panel (16) is secured in groove (84), in this embodiment.

In operation the first or front panel (16) can be lowered, while the second panel (18) remains retracted.

As front panel (16) is lowered it will run around roller (20) in the bottom rail (14). If light is required then the front or lower panel can be adjusted so the dark strips (22) align with each other. This will allow passage of light through the intervening light strips. (24)

If less light is required, or for greater privacy, the front panel can be adjusted so that the dark strips line up with the lighter intervening strips.

It will be seen that the front or lower panel forms in effect two panel portions, namely a front portion and an intermediate portion, spaced from one another. Adjustment of the front and intermediate portions relative to one another, changes the lighting effect inside the building space.

For substantially complete light exclusion the second or upper blind panel (18) is lowered. However the first panel may be allowed to remain hanging down and provides a pleasing aesthetic decorative effect.

The first or lower blind panel hangs down from the rearward side of lower roller (32), clear of the control cords.

The second or upper blind hangs downwardly from the rearward side of upper roller (30), keeping it also clear of the cords.

By this arrangement the profile of the head rail can be maintained as slim as possible, and thus provide an aesthetic appearance, without obtruding into the building interior.

In addition since the object of the blind itself is to control the light entering the building space, the result of keeping both lower and upper blinds to the rear of the head rail, ensures that as far as possible, light is prevented from entering, around the edges of the two panels. In other words, this arrangement keeps both blinds as close as possible to the actual window. The operation of the blind panels by the cords and the manipulation of the cords, can be managed forwardly of the two blind panels, and without contact their edges.

In addition by guiding the cord loops to hang forwardly, the blind panels can fill the full width of the building opening or window, and thus provide maximum privacy, and exclusion of light.

Figure 5:
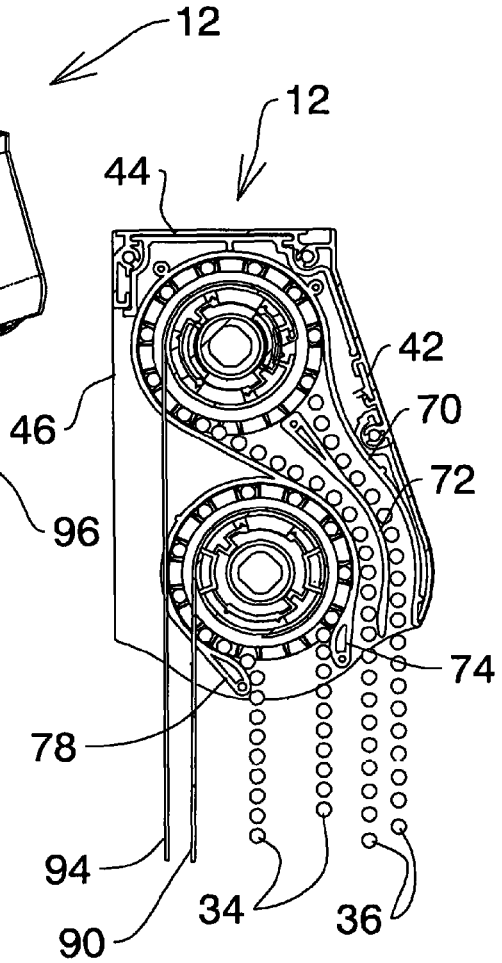
FIG. 5 is a section corresponding to FIG. 2 showing another embodiment.

A somewhat simplified embodiment is shown in FIG. 5.

In this case the front blind panel (90) is a single sheet. There is no loop.

The lower end is attached to a bottom rail (92).

Figure 2:
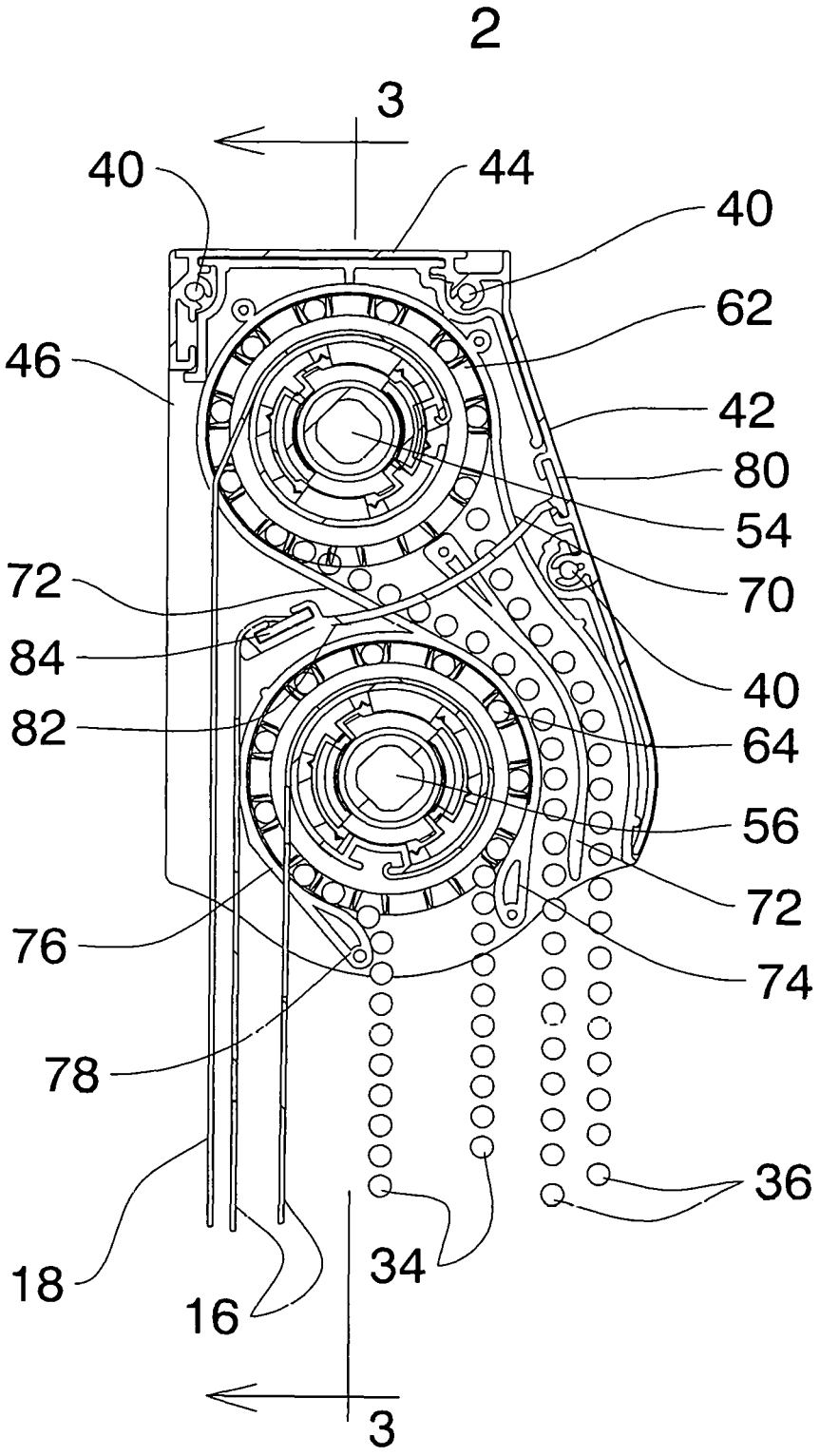
FIG. 2 is a section along line 2-2 of FIG. 1.
Figure 3:
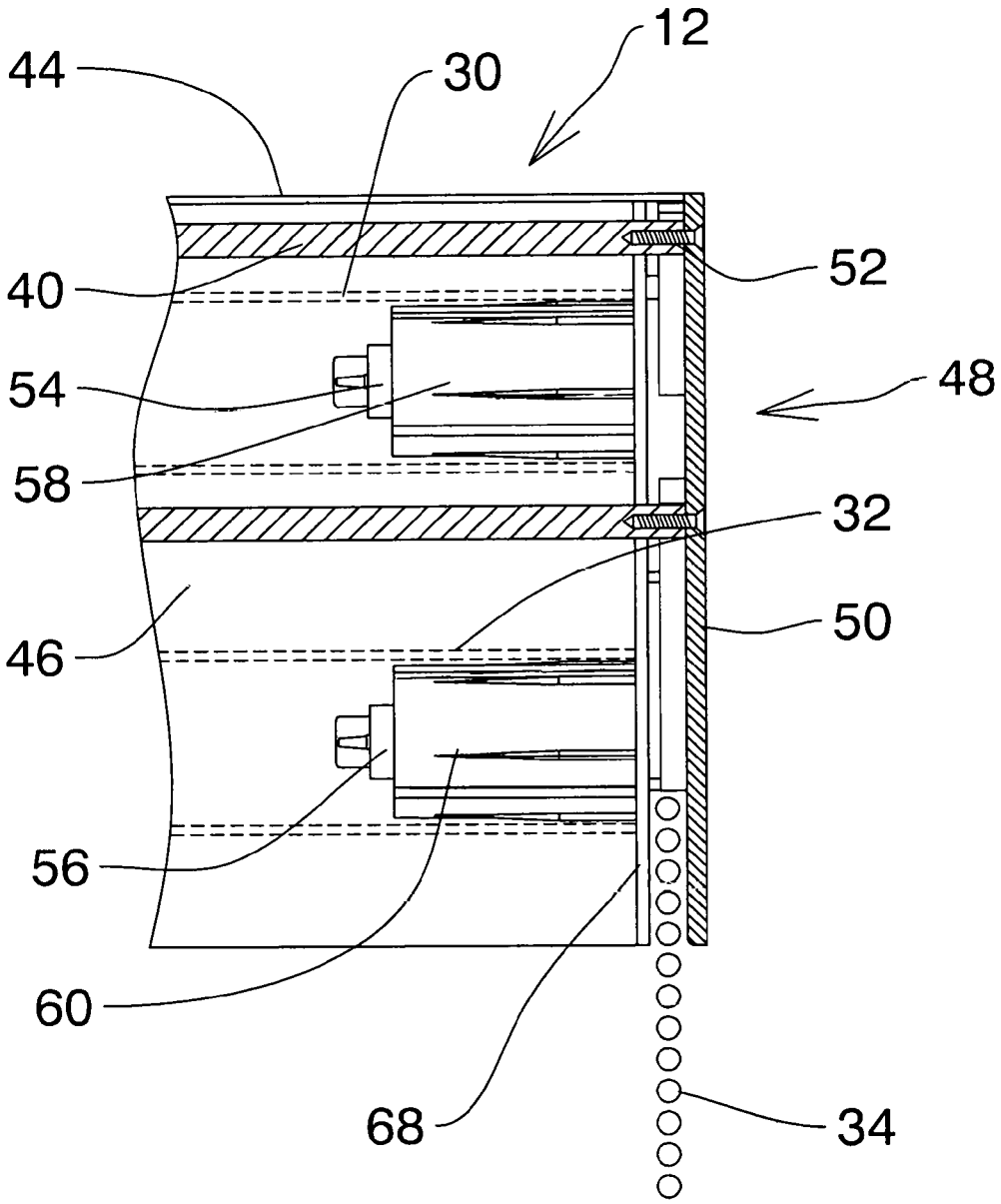
FIG. 3 is a section along line 3-3 of FIG. 1.
Figure 4:
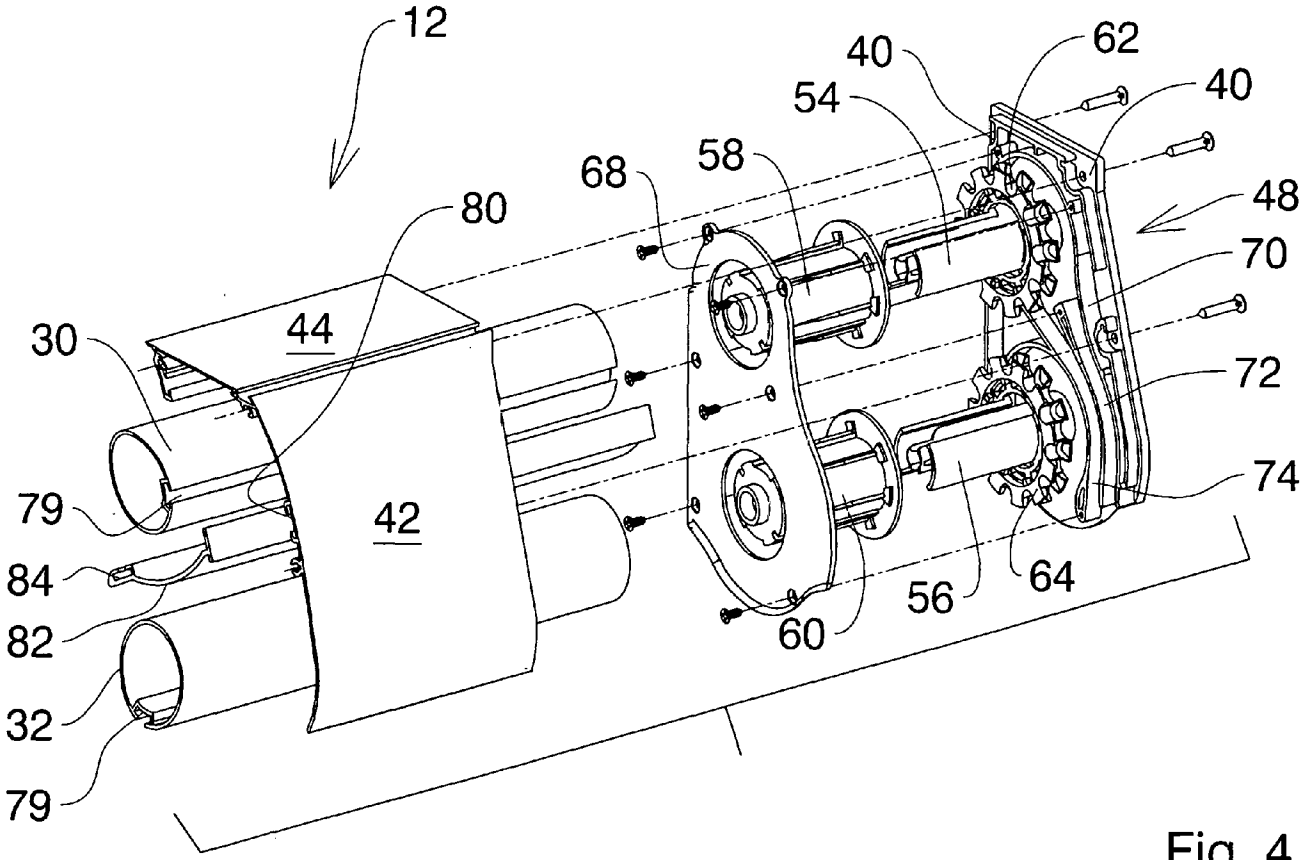
FIG. 4 is an exploded perspective of one end of the headrail.

The fastening wall extrusion (82 of FIG. 2 has been removed as it is not required. There is no dead end of the front panel (90 to be secured, in the head rail.

The second or dark panel (94) is similar to the second panel of FIG. 2.

The control cords and guides are the same as in FIG. 2, and have the same reference numbers.

Figure 6:
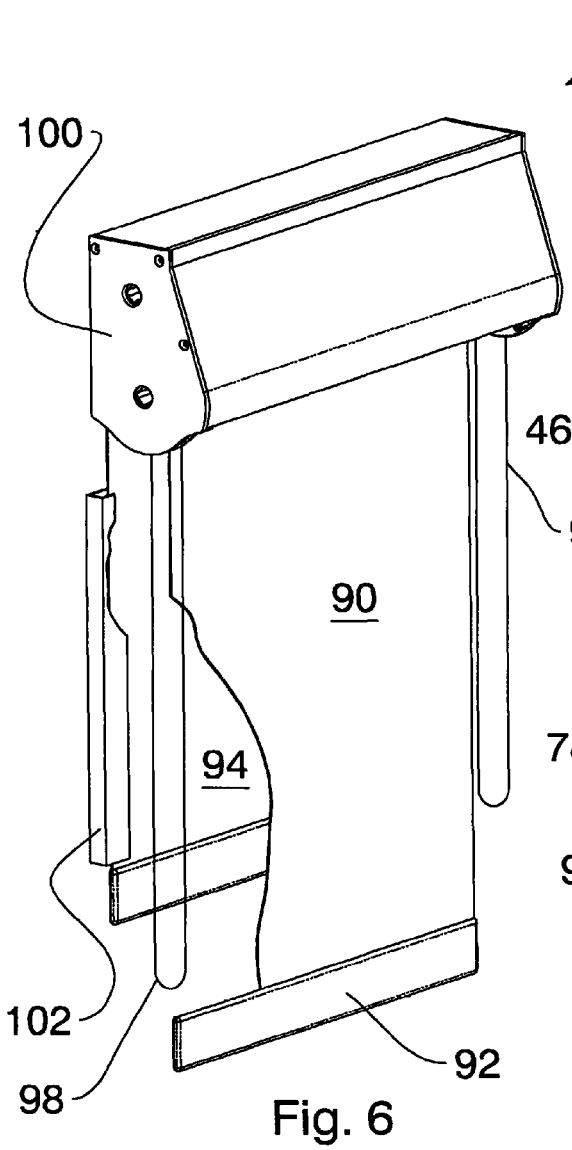
FIG. 6 is a perspective of another embodiment.

The cords are guided, as before, forwardly of the edges of the first and second panels Another possible variation is shown in FIG. 6.

In this case the front blind panel control cord (96) is shown located at one end of the head rail, and the control cord (98) for the second panel is located at the opposite end of the head rail.

In this case the end caps (100) are the same as in FIG. 2, and both sets of control cords are guided forwardly of the edges of the two blind panels.

In some cases, it may be desirable to add an edge channel (102), by attaching it directly to the building fabric down each side of the opening. The edges of the second, dark panel (94) are received in the channels.

In this way light which might otherwise find its way around the edges of the dark panel (94), is eliminated.

Figure 6A:
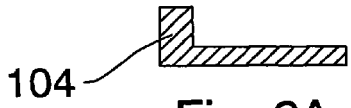
FIG. 6A is a section of an alienate light baffle.

The channels (102) could be replaced by simple L-shaped baffles (104), FIG. 6A, where the building fabric provides a suitable portion to which it may be bonded It is possible that the same head ail can be used for a simpler blind with only a single blind panel. In such a case there would be only one cord loop (not shown), but it would still be guided by the appropriate ribs and hang forwardly of the blind panel, so as to avoid damage to the edge of the panel.

The use of the forward guiding of the control cords also has the result of permitting the blind panel, or panels, to be made to the full width of the window opening, and thus provide for more effective light exclusion, when required.

The head rail can be adapted for use with a variety of different types of blind designs.

Figure 7:
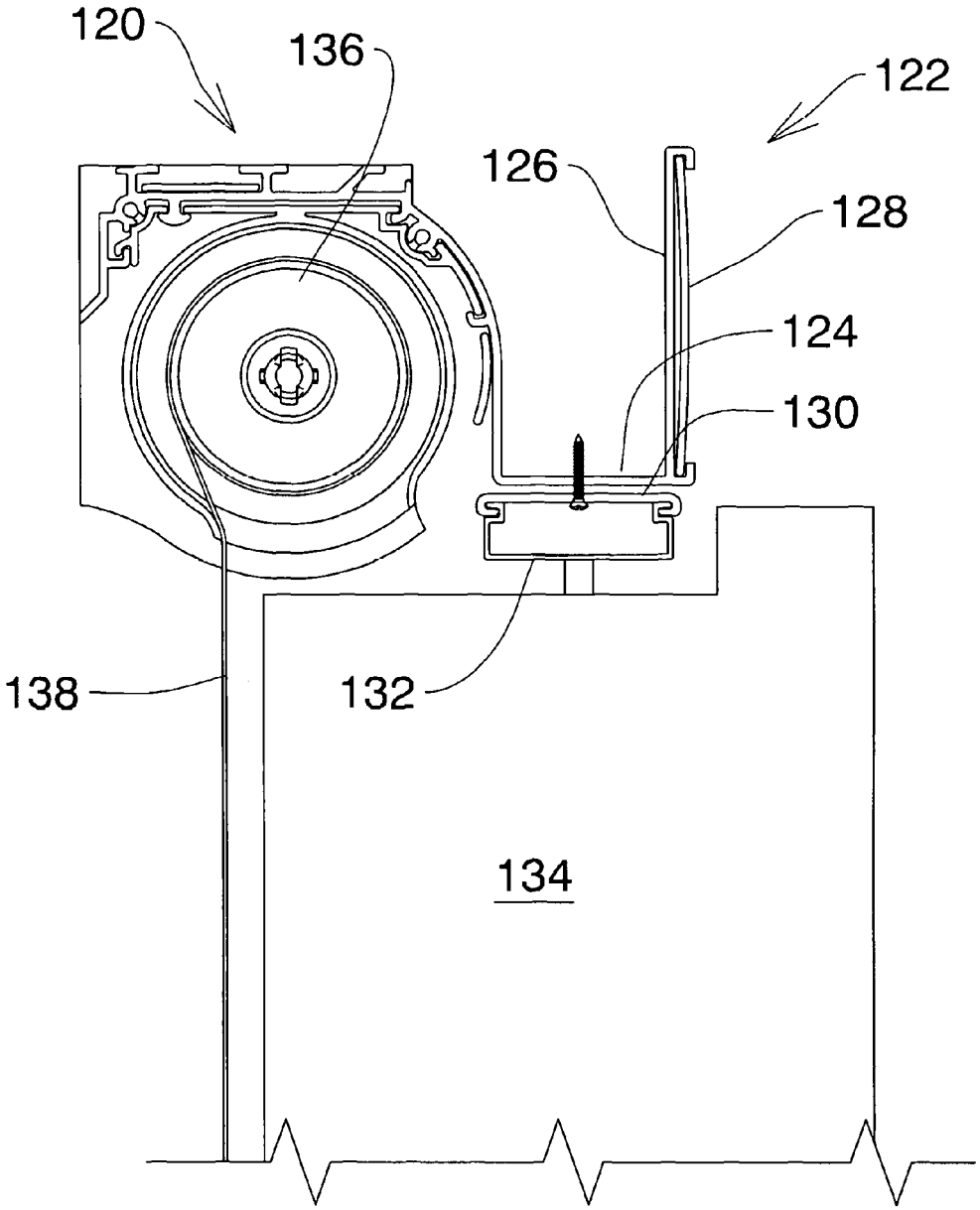
FIG. 7 is a side elevation of another embodiment; showing a vertical strip blind as the front panel, and a dark effect material as the second panel.

FIG. 7 shows the head rail (120), modified somewhat to support a typical vertical blind. Thus head rail (120) has a front wall extension (122) formed integrally.

Extension (122) is of generally L-shaped section, having a horizontal support wall (124) and a vertical front wall (126).

Any suitable trim strip (128) can be supported in vertical wall (126) in known manner.

A lower blind attachment, in this case a transverse elongated linear blind track (130), of known design can be simply secured to the underside of support wall (124). Trolleys (132) on track (130) carry vertical strips (134), in known manner Such vertical blinds can be operated by cords, or by wands, in known manner.

Within head rail (120) a single upper roller (136) carries a second upper blind panel (138). This is formed of opaque dark effect material.

Suitable cords (not shown) are provided for operation of roller (136), being guided forwardly of the edge of panel (138) by guides such as shown in FIGS. 1 to 6.

Thus the vertical strips forming the first blind panel can be deployed to provide some privacy, and some light exclusion, as desired.

By this arrangement the upper blind panel can hang freely down in the rear area of the head rail, without interference from the lower blind carried on the support wall (124) When darkness is required the second panel (138) can be lowered.

Figure 8:
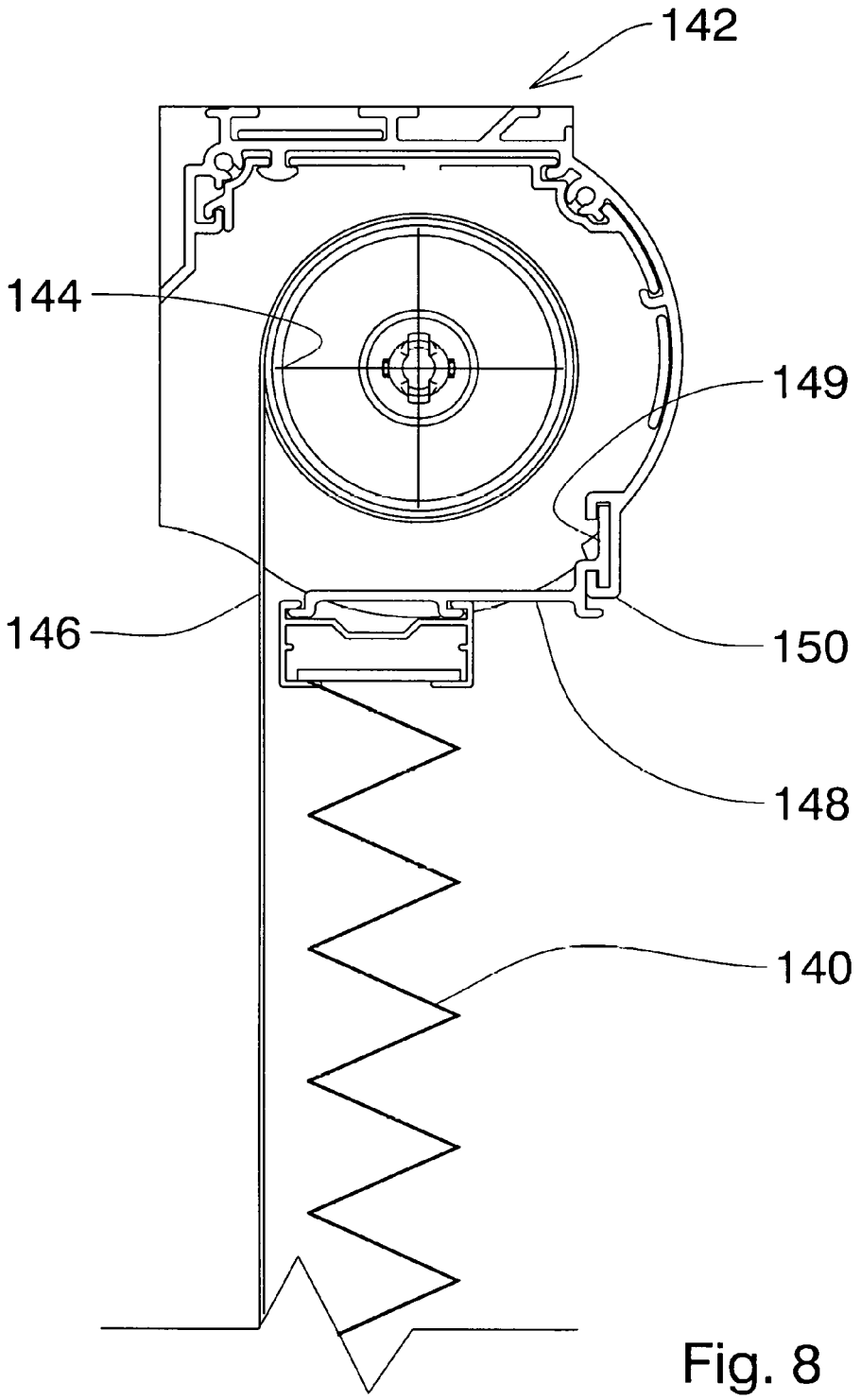
FIG. 8 is a side elevation of another embodiment showing a concertina material as the front panel and a dark effect material as the second panel.

FIG. 8 shows another embodiment. In this case the front or first panel is of concertina type blind material (140), typically made from semi translucent material. In this case the head rail (142) has a single roller (144) for the second or upper panel (146), similar to FIG. 7, being formed from opaque dark effect material. The front or lower panel is supported by a lower blind attachment, in this case by a horizontal support wall (148).

Wall (148) is attachable to front wall of head rail (142), by a slide flange (149) fitting in a channel (150) formed in head rail (142).

The support wall (148) defines two ridges (152), and a rectangular tubular blind housing (154) is slidably attached to the ridges. In this way the attachment of the lower concertina type blind leaves the rear area of head rail (142) clear of obstruction, and the upper blind panel can hang down freely.

Suitable control cords (not shown) are provided (not shown), similar to FIG. 7.

Figure 9:
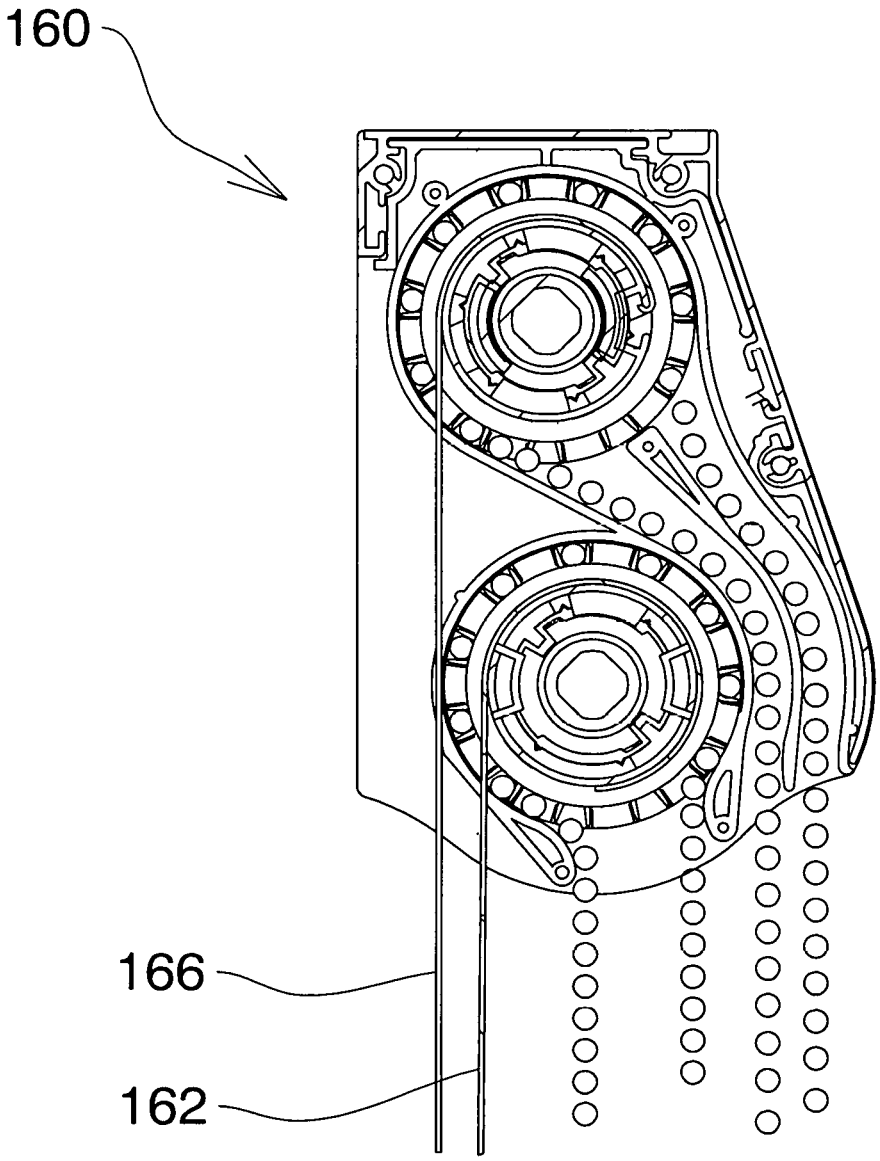
FIG. 9 is a side elevation of another embodiment, showing both first and second panels as being material wound onto rollers.

Another embodiment is shown in FIG. 9.

In this case the head rail (160) is similar to FIGS. 1 to 5, with guides for the control cords, as already described.

In this case the front panel (162) is a simple single panel of semi translucent material, which may, for example be of natural origin, such as bamboo, or other semi translucent fabrics such as are well known.

The second panel (166) is of dark effect opaque material, as before.

Suitable controls operate the respective first and second panels, as before.

Figure 10:
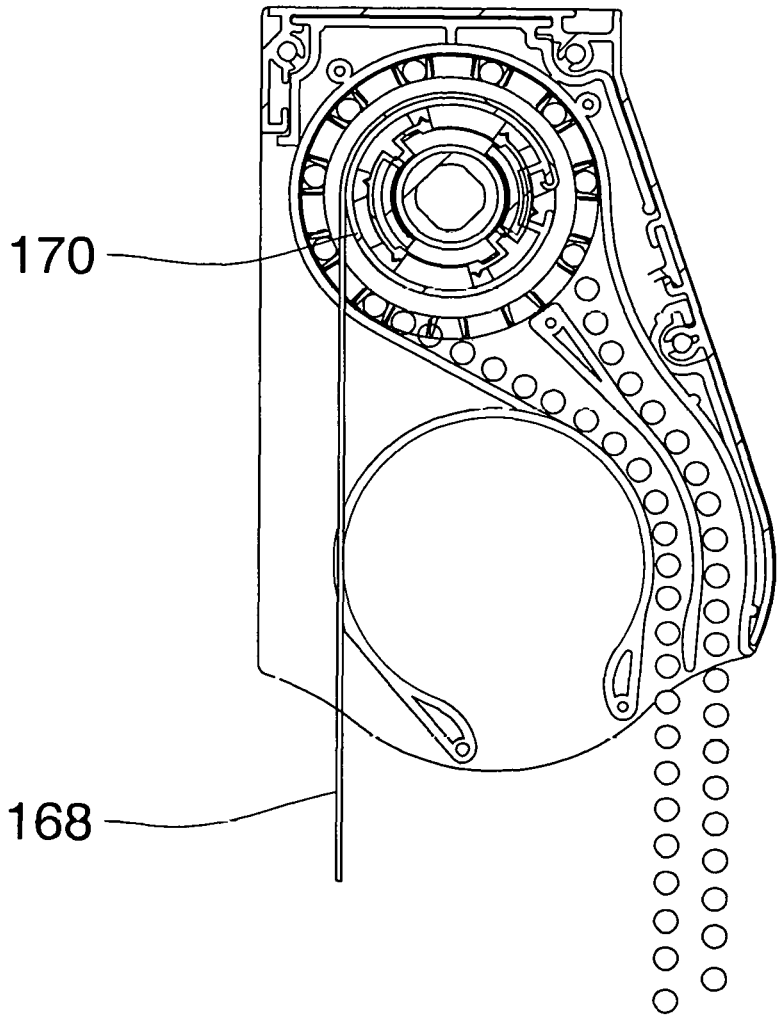
FIG. 10 is a side elevation of another embodiment, showing the head rail of the previous embodiment adapted for use with a single blind panel, with control elements hanging forwardly of the blind panel.

FIG. 10 shows essentially the same embodiment as FIG. 9, but in this case only the one blind panel (168) is shown, on a single roller (170). The head rail is of the same design as FIG. 9, but the space for the front roller, of FIG. 9, is simply unused.

Figure 11:
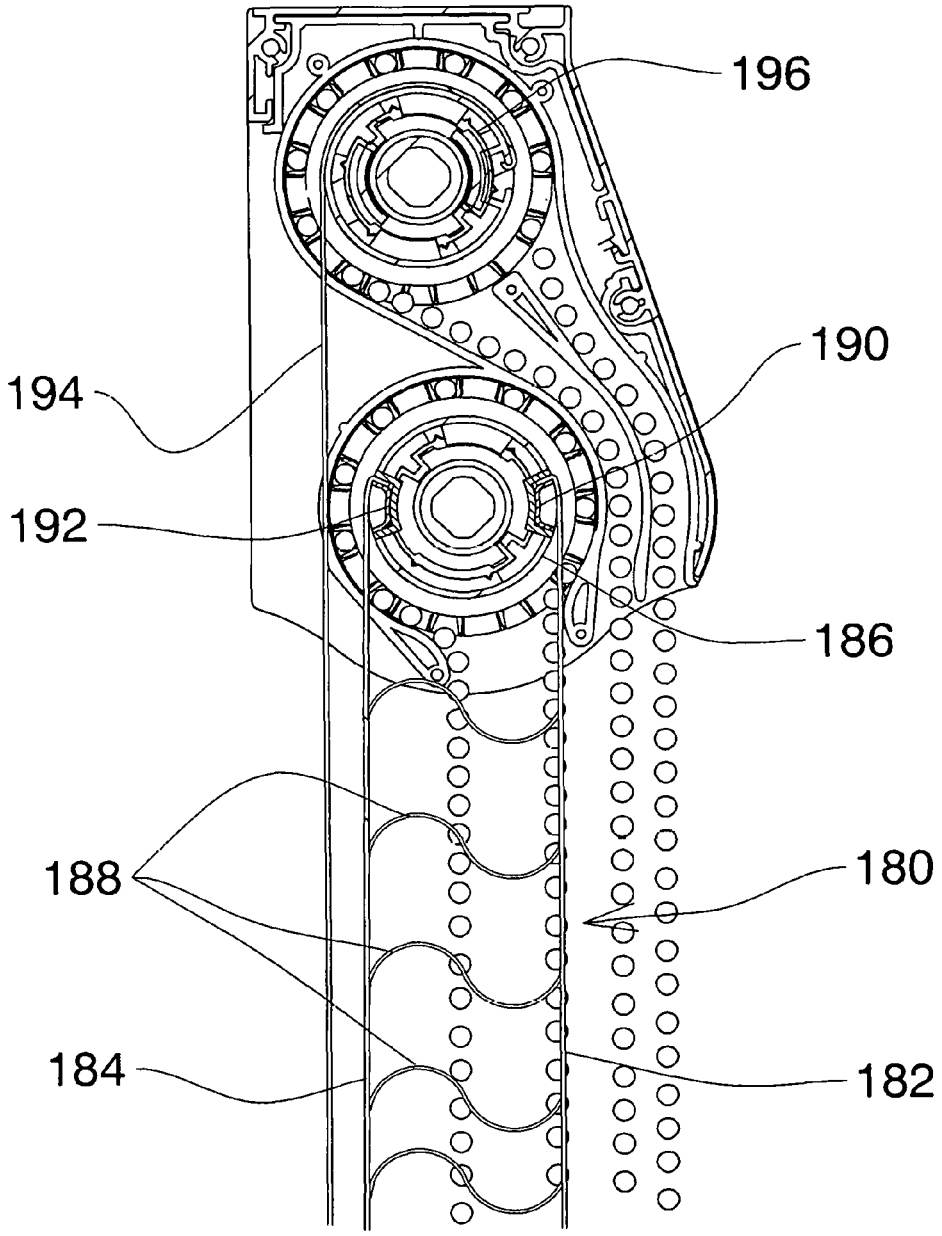
FIG. 11 is a side elevation of another embodiment, showing a front blind panel formed of two sheets of translucent material, with transverse strips extending between the two sheets, and showing a second dark blind panel.

Another embodiment is shown in FIG. 11.

This appears to be similar to the FIG. 2 embodiment.

However in this case the front or first panel (180) consists of two separate sheets of semi translucent material (182) and (184). The two sheets hang from the same roller (186). The two sheets are in fact adapted to be wound up, or lowered from the one roller (186).

Between the two sheets there are a plurality of transverse strips (188) of generally S-shaped configuration. The strips (188) are bonded or joined in other ways, to respective sheets (182) and (184).

The roller control mechanism is of a type known per se, and permits the two sheets to be arranged to hang as shown in FIG. 11, so that they are separated from each other, with one sheet wound up on one side of the roller, and the other sheet wound up on the other side of the roller.

When in this configuration the transverse strips are displaced apart from each other as shown in FIG. 11.

This permits a greater amount of light to pass through the two sheets, into the interior of the building.

By manipulation of the roller, the two sheets (182) and (184) can be displaced relative to one another, so that they will hang from the same side of the roller. This will cause the strips (188) to become rearranged so that they lie in more or less a vertical arrangement. The edges of the strips will register or overlap. This will block passage of more light, giving greater privacy.

Channels (190) and (192) are formed in roller (186) and receive the edges of respective sheets (182) and (184).

The second panel (194) hangs from upper roller (196), and is formed from opaque dark effect material. In this way the front panel can be manipulated, to provide more or less light, and gives a decorative appearance.

Panel (194) can be lowered when light exclusion is required.

Figure 12:
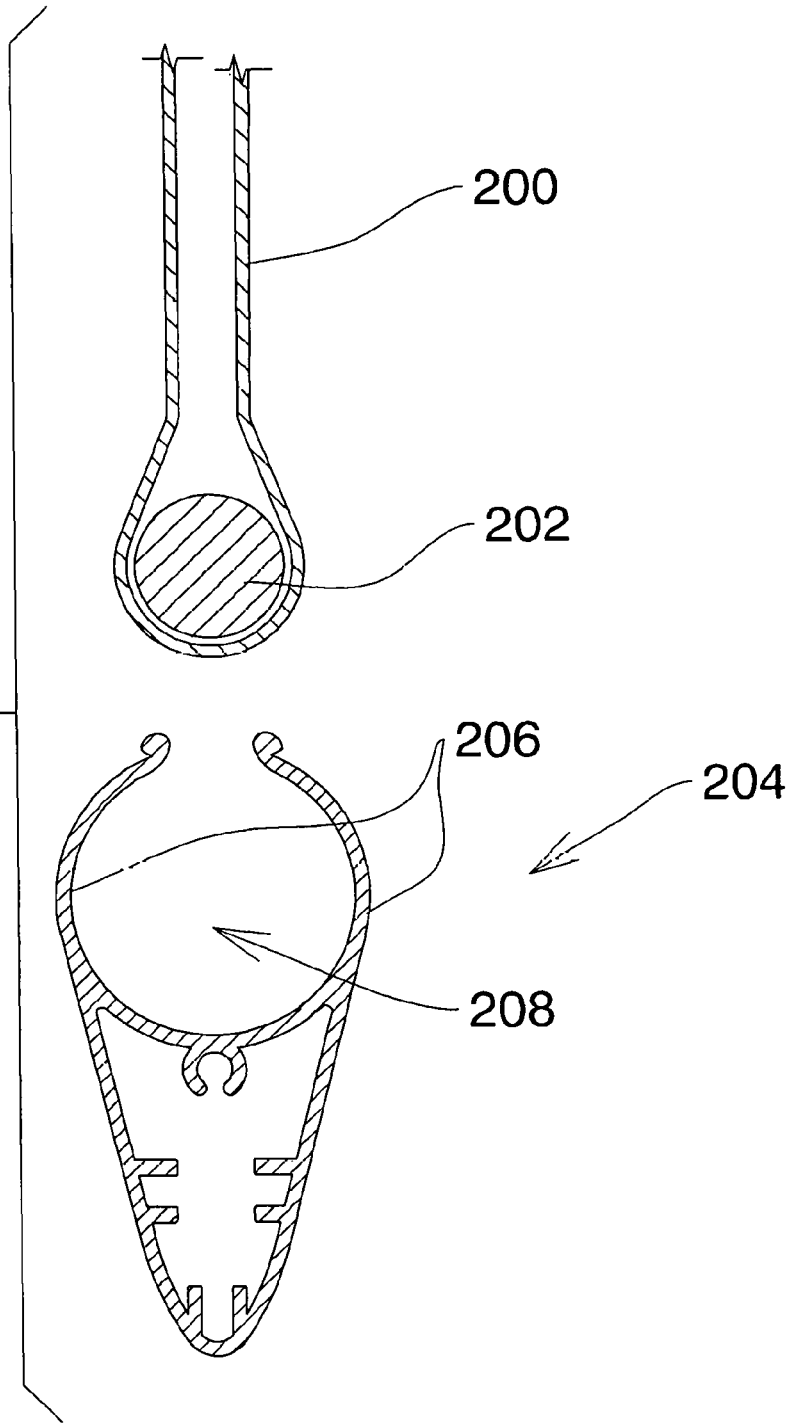
FIG. 12 is a side elevation of another embodiment, showing a front blind panel, formed into a loop and passing around a roller in the bottom rail.

FIG. 12 is a side elevation of another embodiment, showing a front blind panel (200), formed into a loop and passing around a roller (202) in the bottom rail (204)

The bottom rail has two semi cylindrical walls (206) defining a semi-cylindrical channel (208), with an upwardly directed open mouth (210. The panel (200) fits around roller (202), and is trapped between walls (206), but is free to rotate with roller (202) within channel (208).

Figure 13:
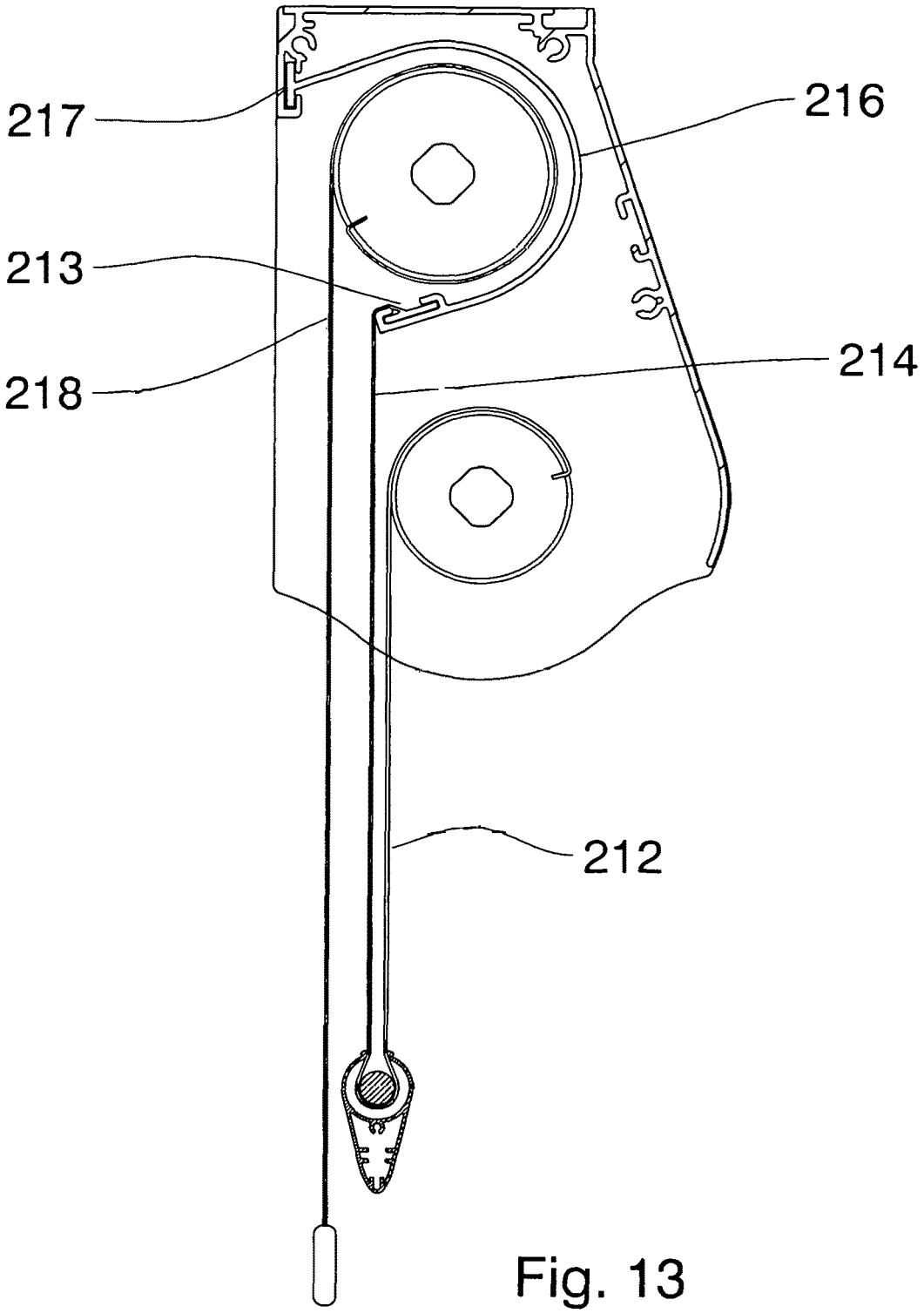
FIG. 13 is a side elevation of another embodiment, showing a front blind panel in the form of a loop with its free end secured in the head rail, on a semi circular wall.

FIG. 13 is a side elevation of another embodiment, showing a front blind panel (212) in the form of a loop with its free end (214) secured to on a semi circular wall (216), formed of metal, or extruded thermoplastic. The wall is secured to the interior of a rear portion of the head rail. Its shape enables it to encircle the upper roller and dark blind (218), without contact.

Figure 14:
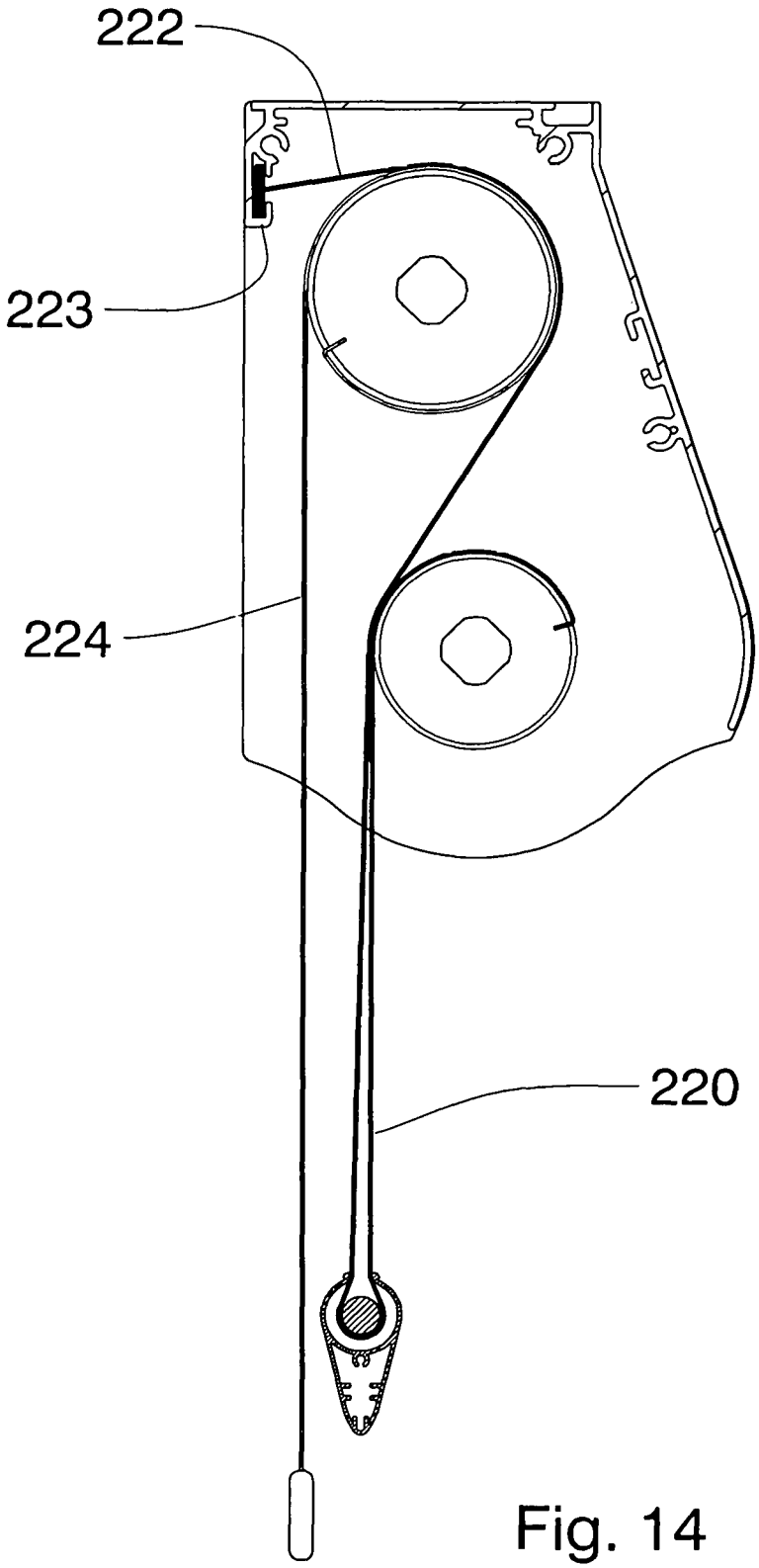
FIG. 14 is a side elevation of another embodiment, showing a front blind panel in the form of a loop, with its free end attached to a rear wall of the head rail.

FIG. 14 is a side elevation of another embodiment, showing a front blind panel (220) in the form of a loop, with its free end (222) attached directly to a rear wall of the head rail in this embodiment the panel (220) will actually contact the dark blind panel (224) on upper and also the front panel (220) on the lower roller. This may result in some wear, if the panels are adjusted frequently, but may be satisfactory for some circumstances.

Figure 15:
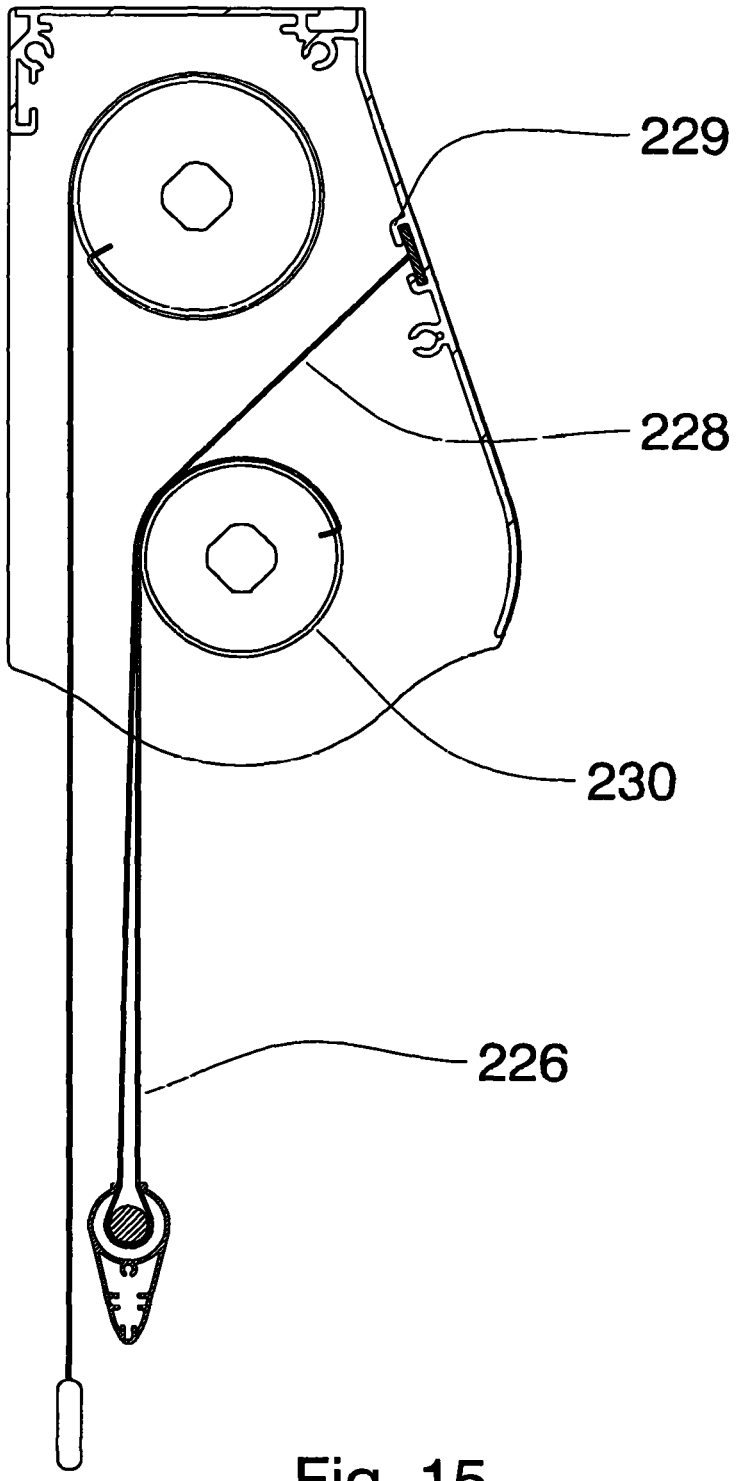
FIG. 15 is a side elevation of another embodiment, showing a front blind panel in the form of a loop with its free end attached to a front wall of the head rail.

FIG. 15 is a side elevation of another embodiment, showing a front blind panel (226) in the form of a loop with its free end (228) attached to a front wall of the head rail. In this case the front panel will be in contact itself, where the free end runs around lower roller (230), but will not contact the dark panel on the upper roller.

Figure 16:
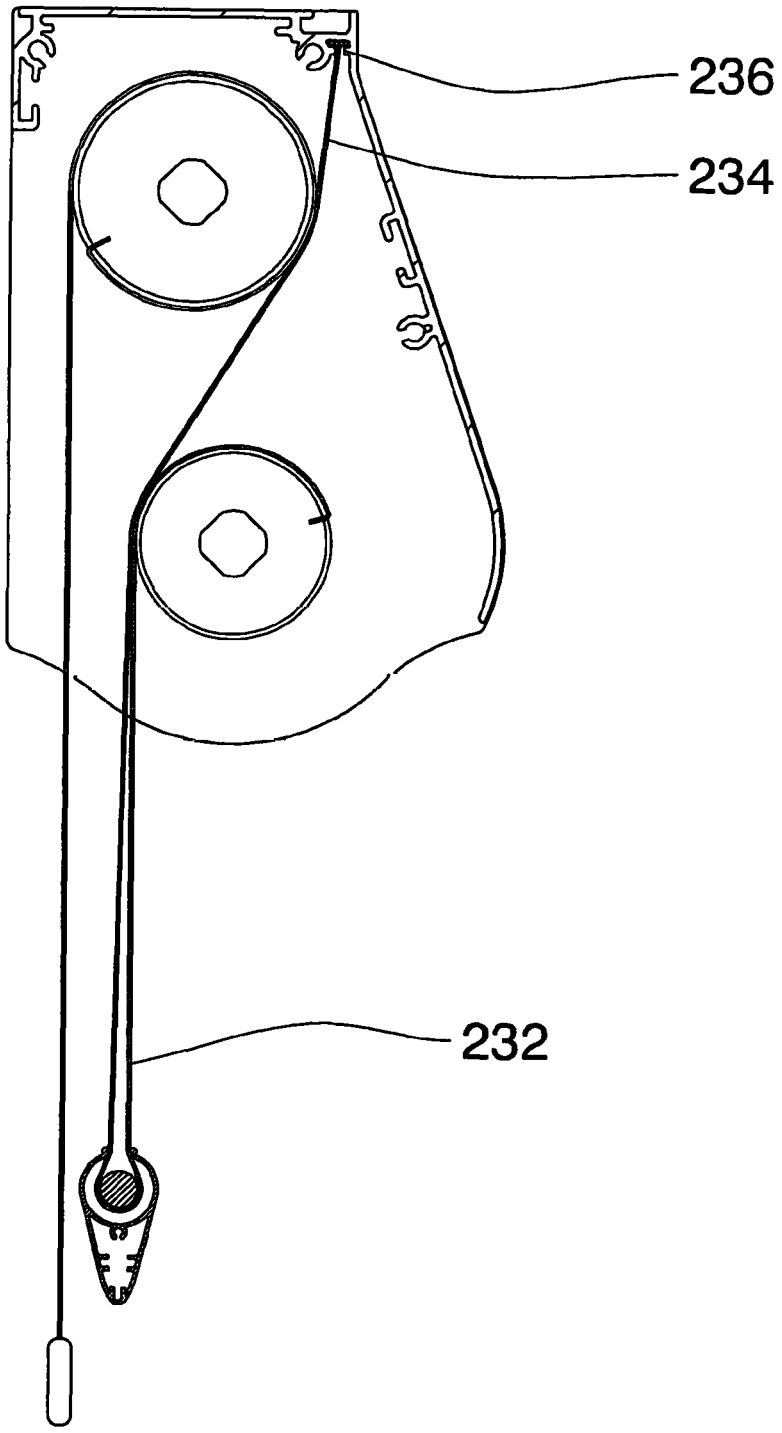
FIG. 16 is a side elevation of another embodiment, showing a front blind panel in the form of a loop with its free end secured to the top wall of the head rail.

FIG. 16 is a side elevation of another embodiment, showing a front blind panel (232) in the form of a loop with its free end (234) secured to the top wall (236) of the head rail. In this case there will be some slight contact between the free end (234) and both the dark blind on the upper roller, and with the front panel on the lower roller. However since the two contact areas are relatively small, the wear will be slight.

Figure 17:
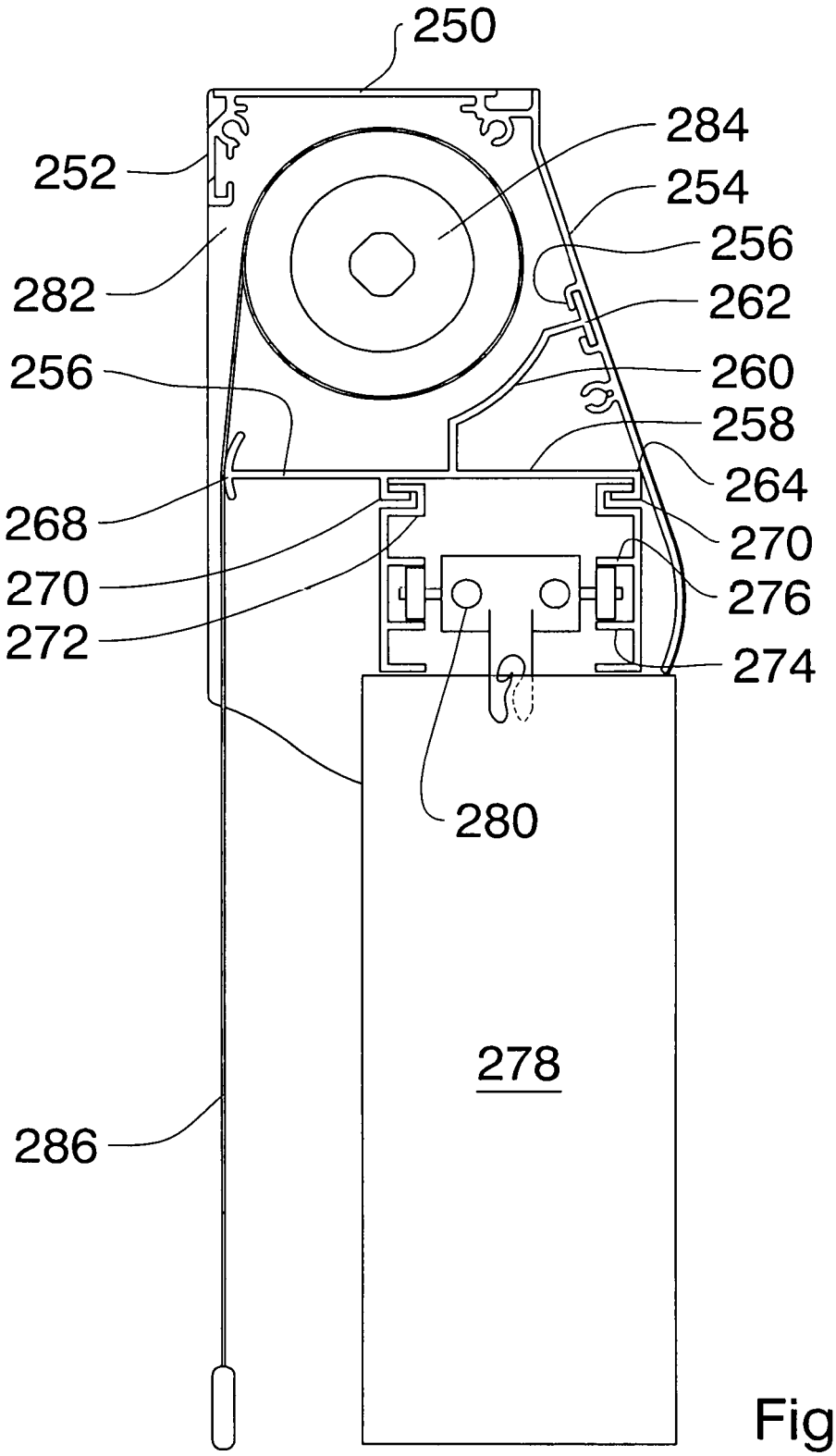
FIG. 17 is a side elevation of a further embodiment showing another combination of the upper roller blind, and the lower vertical blind slat assembly.

A further embodiment of the invention is shown in FIG. 17. This embodiment employs an upper roller carrying a blackout blind, as before, and a lower window covering assembly which in this embodiment consists of a plurality of vertical slats carried on trolleys. The general effect of the FIG. 17 embodiment is somewhat related to the FIG. 7 embodiment. However the FIG. 17 embodiment is simplified and is more aesthetically pleasing, to most customers.

In this embodiment, the outer portion of the head rail comprises an top wall (250), and a partial rear wall (252). A front wall (254) is attached to the top wall and the rear wall, top wall and front wall are all in this embodiment formed by a single extrusion of aluminum forming one single integral structure.

On the inside surface of the front wall (254), there is a axial groove (256) formed. Attached to this groove (256) is a horizontal blind support wall (258). A generally diagonal connecting wall (260) connects between a median point of the support wall (258), and extends upwardly and forwardly and ends in a T-shaped Lock member (262). The T-shaped member is adapted to make a sliding fit in the groove (256). The support wall (258) is dimensioned so that it defines a forward edge (264) which contacts the inside of the front wall (254). The rearward extension (266) of the support wall (258) defines a generally arcuate guide shoe (268).

The engagement between the T-shaped member (262) and the groove (256) on the inside of the front wall (254), and the lower engagement of the forward edge (264) of the horizontal support wall (258), with the inside of front wall (254), form a triangular bracing for maintaining the support wall (258) horizontal and parallel to the top (250) of the head rail. The upper blind on the rollers may be simply of the spring and ratchet lock type. Preferably however, it will be operated manually by an endless chain running round a tooth wheel of a type well known in the art (not shown).

However, it is apparent that both the upper blind, and the vertical blind slats can be operated by electrical motors, and even by remote control, in a manner known in the art and not requiring any special description or illustration.

On the under side of the support wall (258), there are formed a pair of forward and rear L-shaped flanges (270) and (270). These flanges support a tubular horizontal trolley track by arms (272) having two inwardly facing lower and upper rails (274) and (276). Vertical blinds slats (278) are carried on wheeled trolleys (280) which run between respective pairs of rails (274) and (276) in well known manner.

The head rail further defines two end walls (282), only one of which is shown. The end walls support a roller blind system (284). A roller blind panel (286) may be extended from the roller blind system, around the guide shoe (268). The guide shoe (268) holds the roller blind panel clear of the vertical blinds slats. In addition, it ensures that the roller blind panel is held as close as possible to the window opening itself thereby effectively excluding light, when the dark effect is required.

Operation of the roller, and of the trolley system, will be achieved by suitable controls such as are well known in the art and require no special description. They enable the vertical blind slats (278) to be rotated between closed and open positions. They also enable the trolleys (280) to be drawn to one side or the other, or in some cases on both sides, in a manner well known in the art and requiring no special description.

Figure 18:
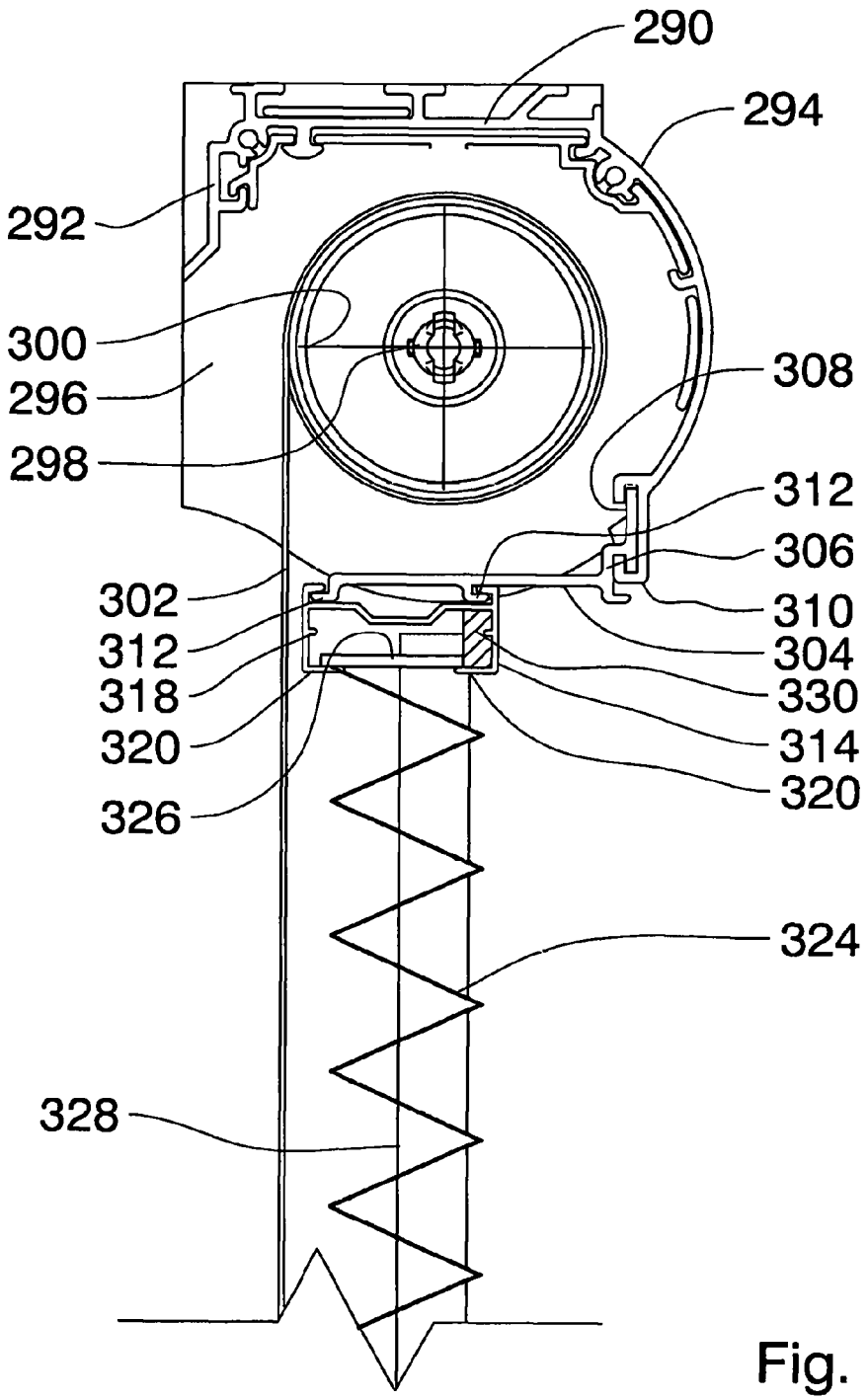
FIG. 18 is a side elevation of a further embodiment.

FIG. 18 is a side elevation of a further embodiment, in this case, combining the upper roller black out blind with a lower vertical shade blind formed of pleated translucent material described below.

In this embodiment, the head rail comprises a top wall (290), a partial rear wall (292) and a curved front wall (294). In this embodiment these three walls are all formed as a single extrusion typically of aluminum. The head rail is provided with two end walls (296), only one being shown in FIG. 18. On the end walls there are support bearings (298) for supporting opposite ends of the upper roller (300). An upper blackout blind (302) is carried on roller (300). Typically this upper roller will be operated by operating cords (not shown) such as those previously described above, and being led forwardly through suitable guides such as described above.

A lower support wall (304) is provided. The support wall is formed with an angled leg (306) and a T-shaped member (308). An attachment channel (310) is formed along the lower extremity of the front wall (294). The T-shaped member can be inter-engaged and slid into the channel, to provide an integral attachment. In this way, the support wall (304) is securely held and maintained in a horizontal position generally parallel to the top wall (290). The support wall (304) is provided with two outwardly turned dependent L-shaped members (312), facing outwardly in opposite directions.

A blind support tube (314) is provided with inturned slide flanges (316). These may be inter-engaged and slid along L-shaped members (312) to provide a secure attachment. Within tube (314), bracing members (318) are provided.

Along the lower extremities of the tube (314), a pair of inturned L-shaped support ledges (320) are formed, in a common plane and defining a spacing there between.

The front or lower blind in this case consists of a panel of generally translucent material which is formed in a series of pleats (324), and having a generally planar top wall attachment portion (326) at its upper extremity, which fits between the ledges (320), with the blind panel material extending down through the spacing between them. In order the raise or lower the front blind, raise cords are (328) provided, extending downwardly from the planar support (326). The raise cords extend downwardly through holes in the panel (322), the holes being located more or less equally spaced between the pleats of the material forming the front blind.

The raise cords (328) are led through a cord lock (330) attached to the support tube (314) forwardly of the lower blind.

Figure 19:
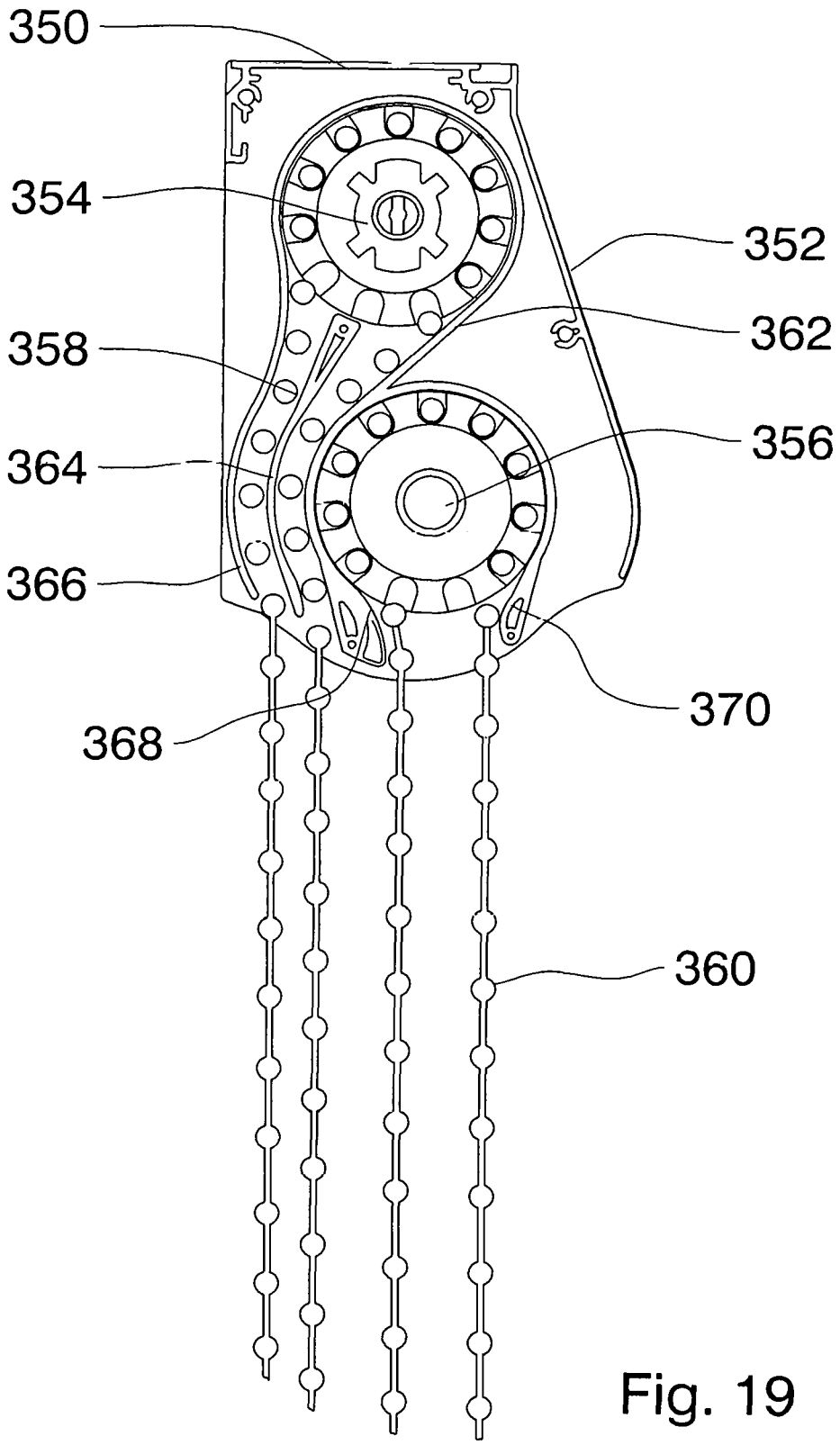
FIG. 19 is a side elevation of a further embodiment.

The invention is not confined exclusively to cords which are guided forwardly. FIG. 19 shows a modification in which a headrail having a top wall (350) and front wall (352) houses an upper blind roller (354) a lower blind roller (356). Upper blind roller (354) is operated by an upper chain cord (358). Lower blind roller (356) is operated by a lower chain cord (360). Upper cord (358) is guided by channel walls (362) and (364) and (366) which curve rearwardly of lower blind roller (356). Lower cord (360) is guided by walls (368) and (370).

The two cords are thus separated from each other.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A blind for a building opening, and having a head rail, attachable adjacent the building opening, said head rail having a top wall, a rear wall, and a front wall integrally formed in one piece, and defining upper and lower regions, and comprising;

an upper blind roller in said upper region;

an attachment channel formed on the interior of said front wall of said head rail, a lower horizontal window covering support wall located in said head rail;

a diagonal support leg extending upwardly and forwardly from said lower horizontal window covering support wall;

connection means between said diagonal support leg and the interior of said front wall defined by an attachment flange formed on said diagonal support leg and being inter-fitted in said attachment channel;

a lower window covering attachment on said lower window covering support wall;

and wherein said lower horizontal support wall defines a forward edge and a rearward extension, and wherein said forward edge contacts the interior of said front wall;

a tubular horizontal track, engaged on said lower window covering attachment;

an upper blind stored on said upper blind roller;

a lower window covering on said tubular horizontal track wherein said upper blind is an opaque black out blind, whereby when said upper blind is raised and said lower window covering is deployed, some light will pass in, and wherein when said upper blind is lowered light is substantially excluded;

upper blind control mechanism operable to lower and raise said upper blind, and, lower window covering control mechanism operable to operate said lower window covering on said tubular horizontal track whereby to provide a head rail having a slim, aesthetically pleasing profile.

2. The blind for a building opening as claimed in claim 1 and wherein said rearward extension of said lower horizontal support wall is enlarged to define a guide rib, for contacting and controlling said upper blind and maintaining said upper blind out of contact with said lower window covering.

3. The blind for a building opening as claimed in claim 2 wherein said lower window covering is formed of a plurality of vertical slats, mounted on trolleys which are slidable along said tubular horizontal track, and wherein said slats are rotatable on said trolleys between open and closed positions.

* * * * *